US011348710B1

(12) United States Patent
Song et al.

(10) Patent No.: US 11,348,710 B1
(45) Date of Patent: May 31, 2022

(54) SURFACE MOUNT METAL OXIDE VARISTOR DEVICE

(71) Applicant: Dongguan Littelfuse Electronics Company Limited, Dongguan (CN)

(72) Inventors: Dongjian Song, Dongguan (CN); Werner Johler, Shanghai (CN); Liang Gu, Dongguan (CN); Libing Lu, Dongguan (CN); Xiaolong Gong, Wuxi (CN)

(73) Assignee: Dongguan Littelfuse Electronics Company Limited, Dongguan (CN)

( * ) Notice: Subject to any disclaimer, the term of this patent is extended or adjusted under 35 U.S.C. 154(b) by 0 days.

(21) Appl. No.: 17/318,319

(22) Filed: May 12, 2021

(51) Int. Cl.

| | |
|---|---|
| ***H01C 7/108*** | (2006.01) |
| ***H01C 17/00*** | (2006.01) |
| ***H01C 1/01*** | (2006.01) |
| ***H01C 1/14*** | (2006.01) |

(52) U.S. Cl.
CPC ..... *H01C 7/108* (2013.01); *H01C 1/01* (2013.01); *H01C 1/14* (2013.01); *H01C 17/006* (2013.01)

(58) Field of Classification Search
CPC ..... H01C 7/12; H01C 17/006; H01C 1/14; H01C 1/01; H01C 7/108
See application file for complete search history.

(56) References Cited

U.S. PATENT DOCUMENTS 4,574,297 A * 3/1986 Ooi ..... H01L 23/49562 257/696
4,810,211 A * 3/1989 Hutnak ..... H01R 13/6616 338/219
4,884,053 A * 11/1989 Bougger ..... H01C 1/148 338/275
4,933,811 A * 6/1990 Dorlanne ..... H05K 3/3426 361/773
4,959,505 A * 9/1990 Ott ..... H01C 17/006 174/536

(Continued)

FOREIGN PATENT DOCUMENTS

CN 2718744 Y 8/2005
CN 103098150 A 5/2013

(Continued)

OTHER PUBLICATIONS

International Search Report and Written Opinion dated Nov. 29, 2021 for PCT/CN2021/077912.

*Primary Examiner* — Kyung S Lee
(74) *Attorney, Agent, or Firm* — KDB PLLC

(57) ABSTRACT

A metal oxide varistor (MOV) device including a MOV chip having first and second electrodes disposed on opposing side thereof, a first lead frame portion including a first contact tab electrically connected to the first electrode and a first lead contiguous with the first contact tab and extending away from the MOV chip, a second lead frame portion including a second contact tab electrically connected to the second electrode and a second lead contiguous with the second contact tab and extending away from the MOV chip, and a device body encasing the MOV chip, the first contact tab, the second contact tab, and portions of the first and second leads, wherein the first and second leads extend out of the device body and are bent into flat abutment with a bottom surface of the device body.

18 Claims, 6 Drawing Sheets

(56) References Cited

U.S. PATENT DOCUMENTS

| | | | | |
|---|---|---|---|---|
| 5,266,739 | A * | 11/1993 | Yamauchi | H01C 1/14 174/540 |
| 8,149,082 | B2 * | 4/2012 | Hirasawa | H01C 1/084 338/226 |
| 8,912,876 | B2 * | 12/2014 | Gomi | H01C 7/10 338/21 |
| 2009/0212900 | A1 * | 8/2009 | Szwarc | H01C 17/28 338/320 |
| 2020/0343051 | A1 | 10/2020 | Kirk et al. | |

FOREIGN PATENT DOCUMENTS

| | | | |
|---|---|---|---|
| CN | 203085305 | U | 7/2013 |
| CN | 208189573 | U | 12/2018 |
| CN | 111968811 | A | 11/2020 |

* cited by examiner

SURFACE MOUNT METAL OXIDE VARISTOR DEVICE

FIELD OF THE DISCLOSURE

The present disclosure relates generally to the field of voltage suppression devices and relates more particularly to a surface mount metal oxide varistor device that is temperature resistant, space saving, and amenable to high speed manufacturing and installation processes.

FIELD OF THE DISCLOSURE

Metal oxide varistors (MOVs) are voltage dependent, nonlinear devices that are commonly employed in electronic circuits for providing transient voltage suppression. A conventional MOV device includes a metal oxide ceramic chip (the MOV) having electrodes disposed on opposite sides thereof. Conducive wire leads may be connected (e.g., soldered) to the metal electrodes to facilitate electrical connection of the MOV device within a circuit. The MOV, the metal electrodes, and portions of the leads that are connected to the electrodes are typically coated with epoxy to protect these components from environmental contaminants and to prevent interference with surrounding electrical devices.

Conventional MOV devices of the type described above are associated with several shortcomings. For example, during installation, the wire leads of a conventional MOV device are inserted into through holes in a printed circuit board (PCB). The wire leads must then be soldered to both the frontside and the backside of the PCB, making the installation procedure incompatible with pick and place processes necessary for achieving high speed, automated assembly. Furthermore, conventional MOV devices stand quite tall on a PCB, which may necessitate an undesirably large form factor in a completed electronic device. Still further, the protective epoxy coating of a conventional MOV device cannot withstand the high operating temperatures (e.g., up to 125 degrees Celsius) necessary for meeting the AEC-Q200 stress resistance standard.

In view of the above, it is desirable to provide a MOV device amenable to installation using high speed, pick and place processes. It is further desirable to provide such an MOV device having a compact form factor compared to conventional MOV devices. It is further desirable to provide such an MOV device capable of withstanding high operating temperatures (e.g., up to 125 degrees Celsius) necessary for meeting the AEC-Q200 stress resistance standard. It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

An exemplary embodiment of a metal oxide varistor (MOV) device in accordance with the present disclosure may include a MOV chip having first and second electrodes disposed on opposing side thereof, a first lead frame portion including a first contact tab electrically connected to the first electrode and a first lead contiguous with the first contact tab and extending away from the MOV chip for connecting the MOV device within a circuit, a second lead frame portion including a second contact tab electrically connected to the second electrode and a second lead contiguous with the second contact tab and extending away from the MOV chip for connecting the MOV device within a circuit, and a device body encasing the MOV chip, the first contact tab, the second contact tab, and portions of the first and second leads, wherein the first and second leads extend out of the device body and are bent into flat abutment with a bottom surface of the device body.

Another exemplary embodiment of a MOV device in accordance with the present disclosure may include a MOV chip having first and second electrodes disposed on opposing side thereof, a first lead frame portion including a first contact tab electrically connected to the first electrode and a first lead contiguous with the first contact tab and extending away from the MOV chip for connecting the MOV device within a circuit, a second lead frame portion including a second contact tab electrically connected to the second electrode and a second lead contiguous with the second contact tab and extending away from the MOV chip for connecting the MOV device within a circuit and a plastic device body encasing the MOV chip, the first contact tab, the second contact tab, and portions of the first and second leads, wherein the first and second leads extend out of the device body and are bent into flat abutment with a bottom surface of the device body, with portions of the first and second leads disposed within complementary recesses formed in the bottom surface.

An exemplary embodiment of a method of manufacturing a metal oxide varistor (MOV) device in accordance with the present disclosure may include stamping first and second lead frame portions out of a sheet of metal, the first and second lead frame portions being "L" shaped and extending from respective first and second frame members, separating the first lead frame portion from the second lead frame portion, bending the first and second leads frame portions to define respective first and second contact tabs, arranging the first and second leads frame portions in a mirror image relationship with the first contact tab of the first lead frame portion disposed in a confronting, parallel relationship with the second contact tab of the second lead frame portion, placing a MOV chip between the first and second contact tabs and electrically connecting the first and second contact tabs to respective first and second electrodes of the MOV chip, overmolding a device body onto the MOV chip, the first and second contact tabs, and portions of first and second leads of the first and second lead frame portions, cutting the first and second leads away from the first and second frame members, and bending the first and second leads into flat abutment with a bottom surface of the device body.

DETAILED DESCRIPTION

Figure 1A:
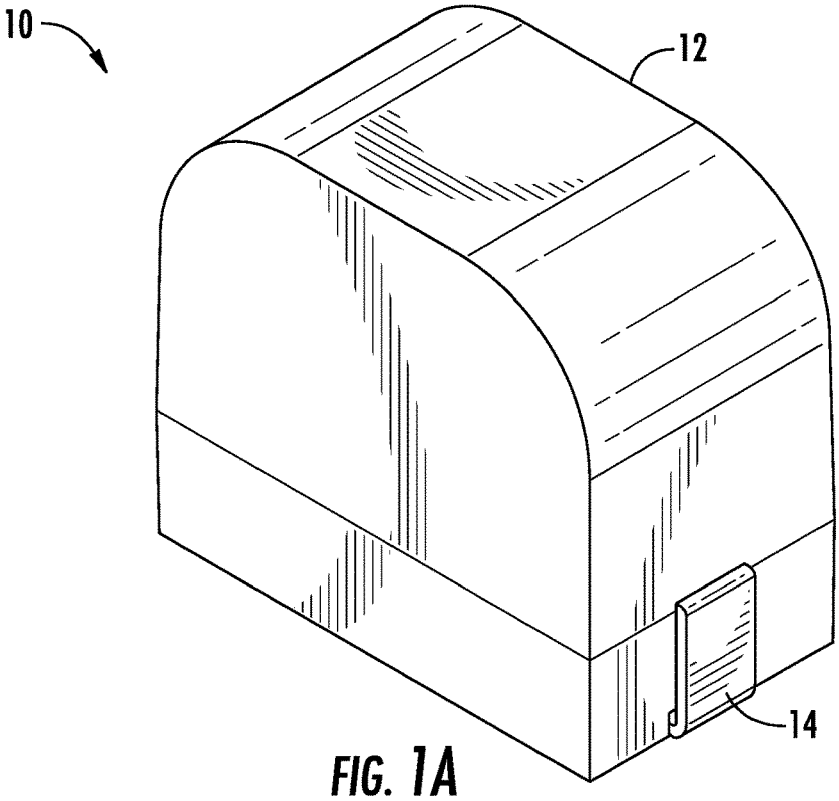
FIG. 1A is a perspective top view illustrating a MOV device in accordance with an exemplary embodiment of the present disclosure.

Embodiments of a metal oxide varistor (MOV) device and a method for manufacturing the same in accordance with the present disclosure will now be described more fully with reference to the accompanying drawings, in which preferred embodiments of the present disclosure are presented. The MOV device and the accompanying method of the present disclosure may, however, be embodied in many different forms and should not be construed as being limited to the embodiments set forth herein. Rather, these embodiments are provided so that this disclosure will convey certain exemplary aspects of the MOV device and the accompanying method to those skilled in the art. In the drawings, like numbers refer to like elements throughout unless otherwise noted.

Figure 1B:
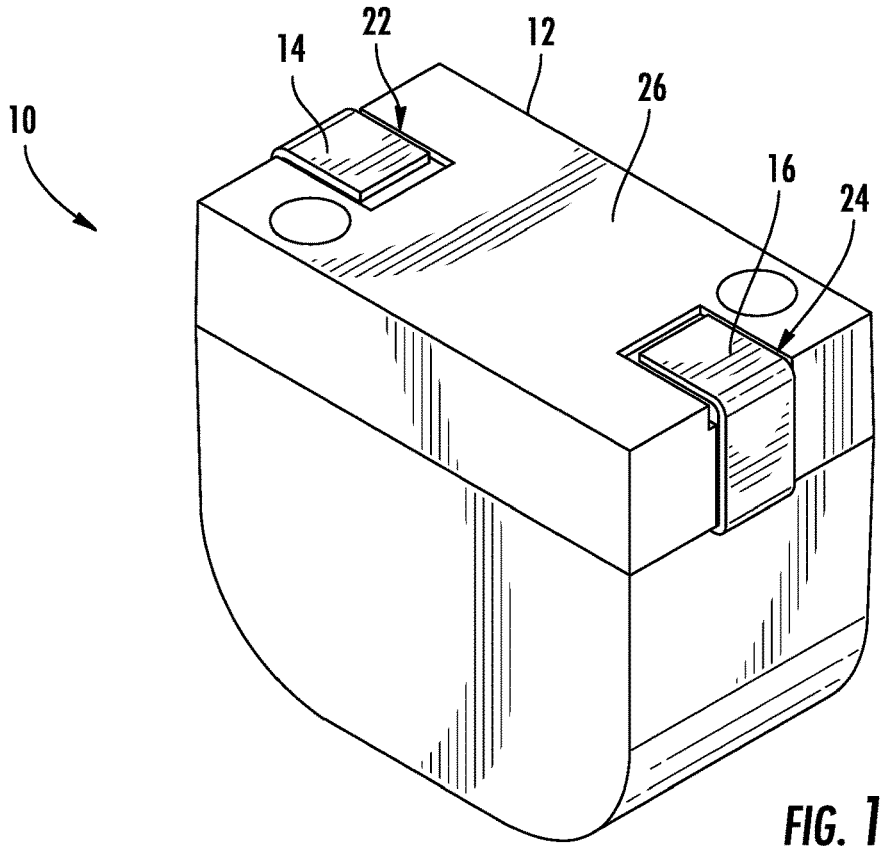
FIG. 1B is a perspective bottom view illustrating the MOV device shown in FIG. 1A.

Referring to FIGS. 1A and 1B, perspective top and bottom views of an exemplary embodiment of a metal oxide varistor (MOV) device 10 (hereinafter "the device 10") in accordance with the present disclosure are shown. For the sake of convenience and clarity, terms such as "front," "rear," "top," "bottom," "up," "down," "above," "below," etc. may be used herein to describe the relative placement and orientation of various components of the device 10, each with respect to the geometry and orientation of the device 10 as it appears in FIGS. 1A and 1B. Said terminology will include the words specifically mentioned, derivatives thereof, and words of similar import.

The device 10 may include a plastic device body 12 having a generally monolithic outward appearance. Electrically conductive first and second leads 14, 16 may extend from opposing sides (e.g., front and rear sides) of the device body 12 and may be folded or bent around an underside of the device body 12, with end portions of the first and second leads 14, 16 being disposed within complementary recesses 22, 24 formed in the bottom surface 26 of the device body 12. Thus, bottom surfaces of the first and second leads 14, 16 may be substantially coplanar with the bottom surface 26.

Figure 2A:
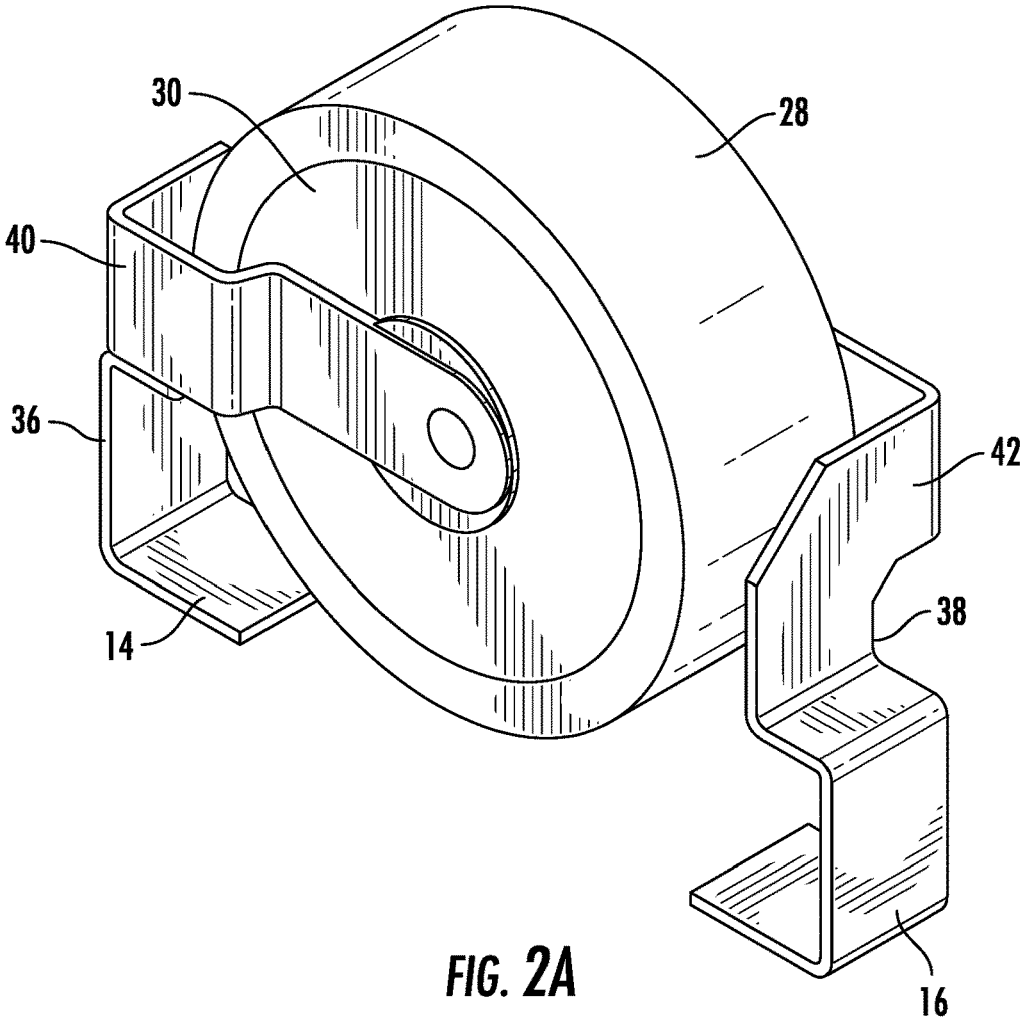
FIG. 2A is a perspective top view illustrating the MOV device shown in FIG. 1A with the device body removed.
Figure 2B:
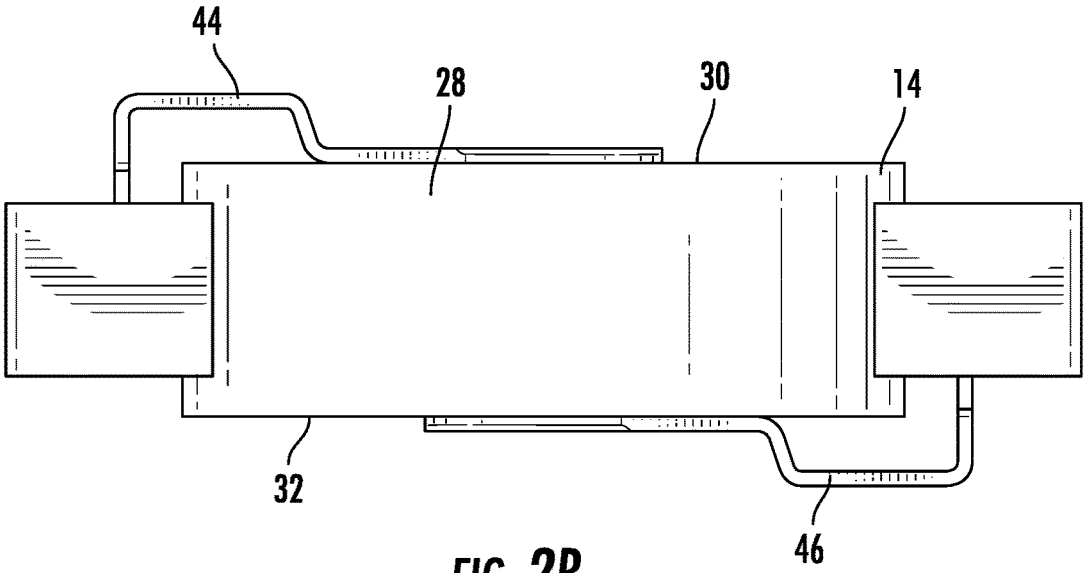
FIG. 2B is a bottom view illustrating the MOV device shown in FIG. 1A with the device body removed.

Referring to FIGS. 2A and 2B, a perspective top view and a bottom view of the device 10 are shown with the device body 12 removed. The device 10 may include a MOV chip 28 having first and second electrodes 30, 32 disposed on opposite sides thereof. Only one side of the MOV chip 28 is visible in FIG. 2A, but it will be understood that the second electrode 32 on the opposing side of the MOV chip 28 that is not within view may be substantially identical to the first electrode 30. The MOV chip 11 may be formed of any MOV composition known in the art, including, but not limited to, zinc oxide granules embedded in ceramic. The first and second electrodes 30, 32 may be formed of any suitable electrically conductive material, including, but not limited to, aluminum, copper, aluminum covered with copper, silver, tin, nickel, etc. The MOV chip 28 and the first and second electrodes 30, 32 are depicted as being circular or disc-shaped, but this is not critical. It is contemplated that one or more of the MOV chip 28 and the first and second electrodes 30, 32 may have a different shape, such as rectangular, triangular, irregular, etc. without departing from the scope of the present disclosure.

The device 10 may further include first and second lead frame portions 36, 38, of which the above described first and second leads 14, 16 are parts, respectively. As shown, the first and second leads 14, 16 may be bent or folded to define a "C" shape that extends away from the MOV chip 28, out of the device body 12 and around a bottom of the device body 12 (see FIGS. 1A and 1B). In addition to the first and second leads 14, 16, the first and second lead frame portions 36, 38 may include first and second contact tabs 40, 42 that are contiguous with the first and second leads 14, 16. The first and second contact tabs 40, 42 may be bent or folded to extend around opposing sides of the MOV chip 28 and are secured to the first and second electrodes 30, 32, respectively, such as with high temperature solder. The present disclosure is not limited in this regard.

In various embodiments, the first and second contact tabs 40, 42 may be bent or folded to define respective first and second kinked portions 44, 46 located adjacent the edges of the MOV chip 28. The first and second kinked portions 44, 46 increase the distance between the first and second contact tabs 40, 42 and the opposing first and second electrodes 30, 32 along the surfaces of the MOV chip 28 (i.e., relative to a configuration in which the first and second contact tabs 40, 42 are entirely planar and extend unkinked along the sides of the MOV chip 28 to the edges of the MOV chip 28). This increase in distance mitigates the risk of flashover between the first and second contact tabs 40, 42 and the opposing first and second electrodes 30, 32. In various embodiments, the gaps between the first and second contact tabs 40, 42 and the respective, adjacent first and second electrodes 30, 32 (i.e., the standoff distances therebetween) may measure about 0.70 millimeters to about 0.90 millimeters, for example. The present disclosure is not limited in this regard.

The MOV chip 28, first and second electrodes 30, 32, and the first and second contact tabs 40, 42 of the first and second lead frame portions 36, 38 may be entirely encased within the device body 12 (see FIGS. 1A and 1B), with the first and second leads 14, 16 extending out of, and around a bottom surface 26 of, the device body 12 as described above. In various embodiments, the device body 12 may be formed of heat-resistant polymer that provides a good humidity barrier and that has high flowability when melted (e.g., during molding). Examples of such polymers include liquid-crystal polymers (LCPs) and polyphenylene sulfide (PPS). The present disclosure is not limited in this regard.

Referring again to FIGS. 1A and 1B, the device 10 may have a substantially planar bottom surface 26, with the bottom surfaces of the first and second leads 14, 16 being substantially coplanar with the bottom surface 26. Thus, the device 10 provides an advantage relative to conventional MOV devices in that the device 10 can be flatly disposed on a PCB using high speed pick and place processes, and the first and second leads 14, 16 can be soldered to a PCB (requiring soldering to the frontside of the PCB only) using reflow or wave soldering processes, for example. The device 10 provides a further advantage in that it has a compact form factor (e.g., stands shorter on a PCB) compared to conventional MOV devices. The device 10 provides a further advantage relative to conventional MOV devices in that the plastic device body 12 allows the device to withstand high operating temperatures (e.g., up to 125 degrees Celsius) necessary for meeting the AEC-Q200 stress resistance standard.

Figure 3:
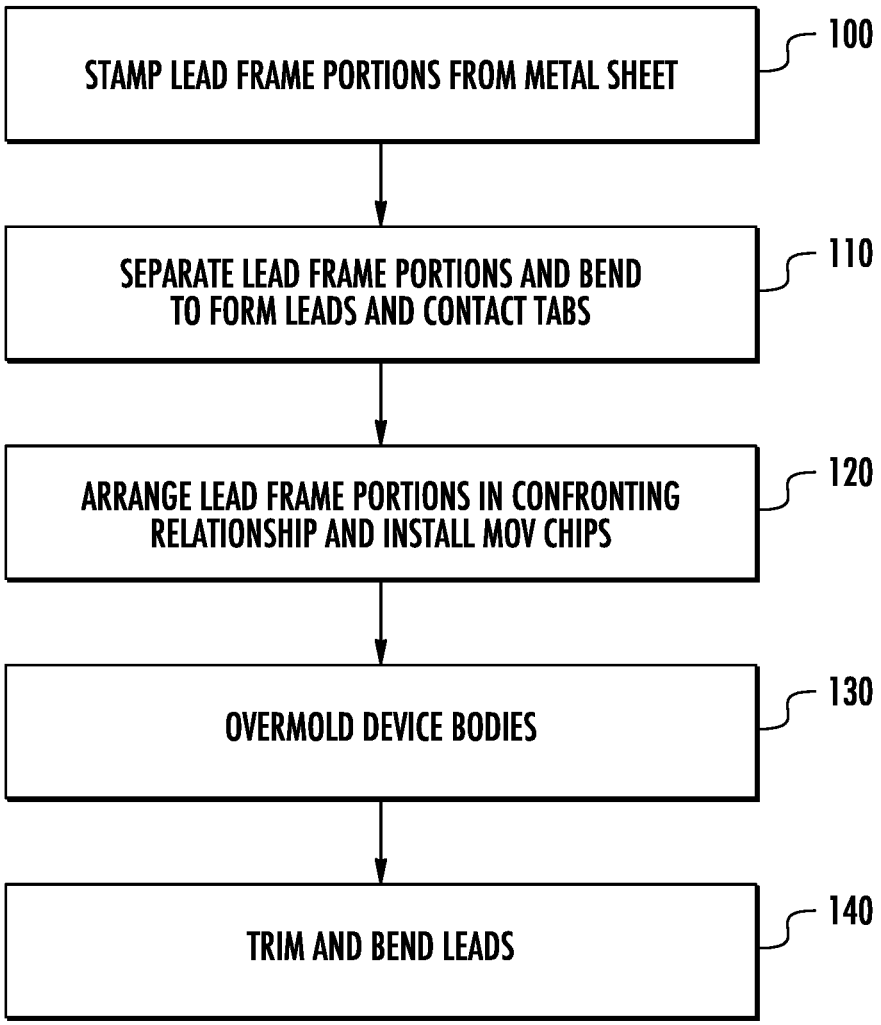
FIG. 3 is a flow diagram illustrating an exemplary method of manufacturing the MOV device shown in FIG. 1A.

Referring to FIG. 3, a flow diagram illustrating an exemplary method for manufacturing the above-described MOV device 10 in accordance with the present disclosure is shown. The method will now be described in conjunction with the flow diagram shown in FIG. 3 as well as a series of views shown in FIGS. 4-8 illustrating various processes performed as part of the method.

Figure 4:
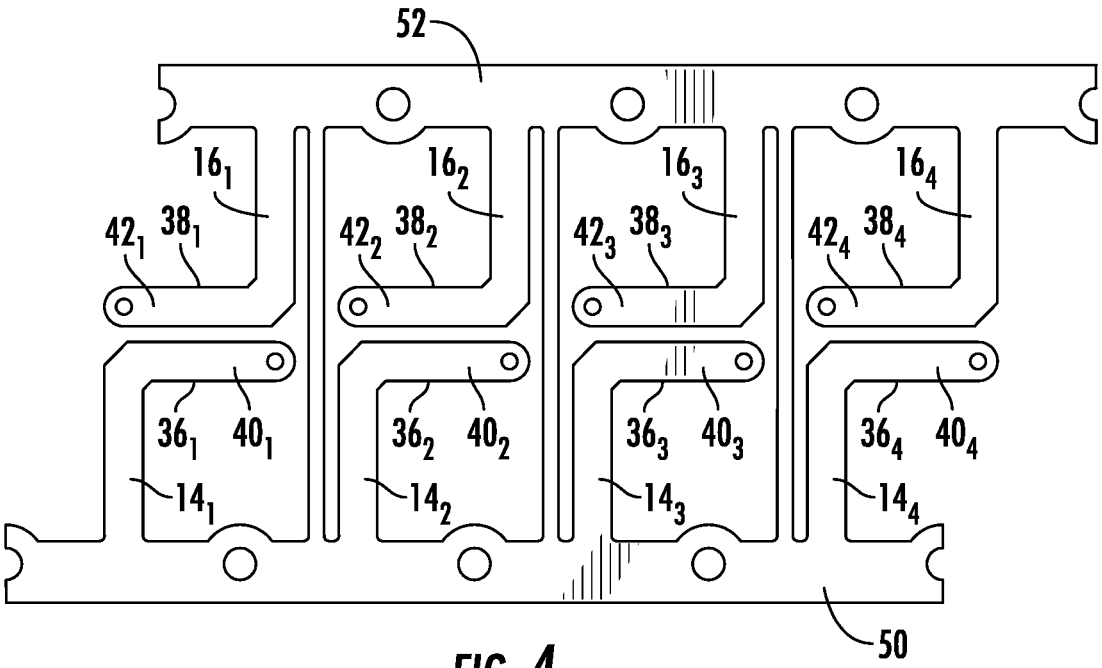
FIGS. 4-8 are a series of view illustrating various processes performed in accordance with the manufacturing method set forth in FIG. 3.

At block 100 of the exemplary method, and as illustrated in FIG. 4, a plurality of first lead frame portions $\mathbf{36}_{1\text{-}4}$ and second lead frame portions $\mathbf{38}_{1\text{-}4}$ may be stamped or otherwise cut from a sheet of metal. The first and second lead frame portions $\mathbf{36}_{1\text{-}4}$, $\mathbf{38}_{1\text{-}4}$ may be "L" shaped and may define first and second leads $\mathbf{14}_{1\text{-}4}$, $\mathbf{16}_{1\text{-}4}$ and first and second contact tabs $\mathbf{40}_{1\text{-}4}$, $\mathbf{42}_{1\text{-}4}$, respectively (as yet unbent in the manner described above). In various embodiment The first and second lead frame portions $\mathbf{36}_{1\text{-}4}$, $\mathbf{38}_{1\text{-}4}$ may extend from respective first and second frame members 50, 52 which may facilitate a continuous, reel-to-reel stamping process whereby large quantities of frame members (i.e., greater than the four pictured) may be rapidly a stamped from a continuous roll of sheet metal.

Figure 5:
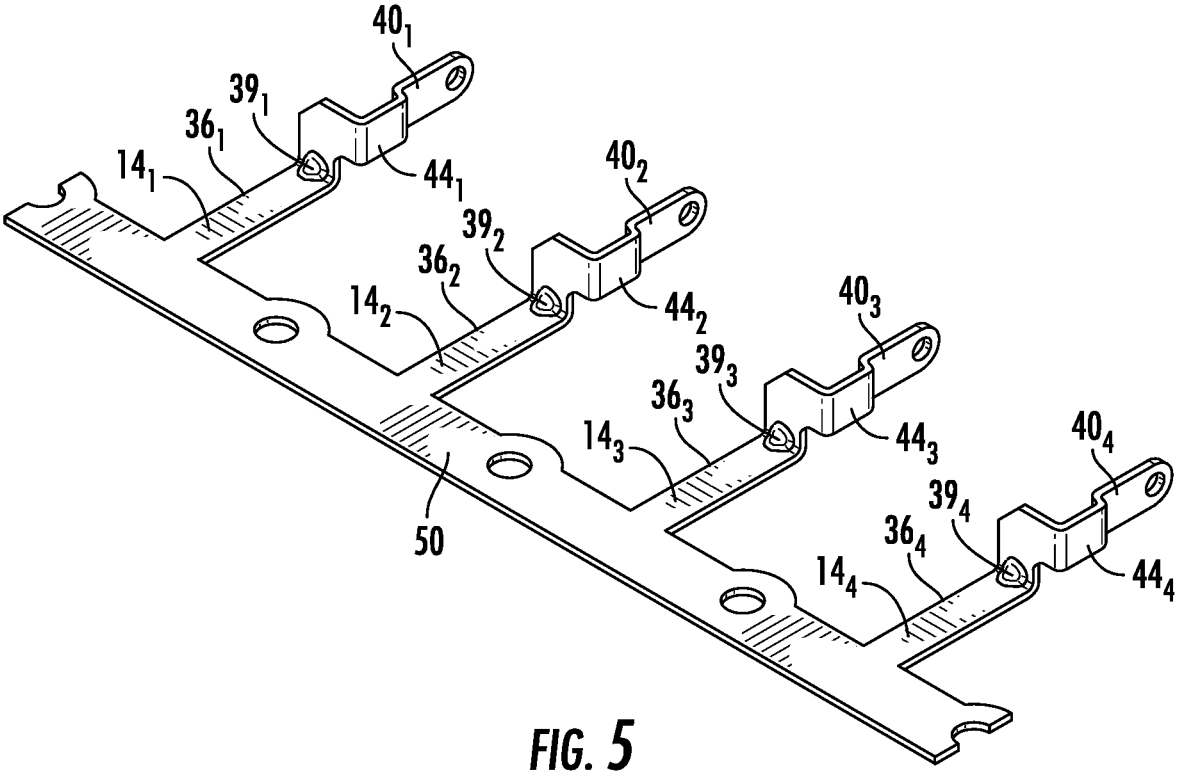

At block 110 of the exemplary method, and as illustrated in FIG. 5, the first and second lead frame portions $\mathbf{36}_{1\text{-}4}$, $\mathbf{38}_{1\text{-}4}$ may be separated from one another, and the first and second contact tabs $\mathbf{40}_{1\text{-}4}$, $\mathbf{42}_{1\text{-}4}$ of each of the first and second lead frame portions $\mathbf{36}_{1\text{-}4}$, $\mathbf{38}_{1\text{-}4}$ may be bent/folded into their final shape described above (only the first lead frame portions $\mathbf{36}_{1\text{-}4}$ are pictured in FIG. 5, but it will be understood that the second lead frame portions $\mathbf{38}_{1\text{-}4}$ are identical to the first lead frame portions $\mathbf{36}_{1\text{-}4}$). Specifically, portions of the first and second contact tabs $\mathbf{40}_{1\text{-}4}$, $\mathbf{42}_{1\text{-}4}$ proximate their corresponding first and second leads $\mathbf{14}_{1\text{-}4}$, $\mathbf{16}_{1\text{-}4}$ may be bent to extend vertically upwardly, and portions of the first and second contact tabs $\mathbf{40}_{1\text{-}4}$, $\mathbf{42}_{1\text{-}4}$ distal from their corresponding first and second leads $\mathbf{14}_{1\text{-}4}$, $\mathbf{16}_{1\text{-}4}$ may be bent to extend horizontally away from their corresponding first and second frame members 50, 52, with respective first and second kinked portions $\mathbf{44}_{1\text{-}4}$, $\mathbf{46}_{1\text{-}4}$ formed therein. In various embodiments, the first and second lead frame portions $\mathbf{36}_{1\text{-}4}$, $\mathbf{38}_{1\text{-}4}$ may include embossed ribs $\mathbf{39}_{1\text{-}4}$ (formed during the above-described stamping process) at junctures of the first and second leads $\mathbf{14}_{1\text{-}4}$, $\mathbf{16}_{1\text{-}4}$ and their respective first and second contact tabs $\mathbf{40}_{1\text{-}4}$, $\mathbf{42}_{1\text{-}4}$ to provide the folds formed at such junctures with increased strength to withstand subsequent molding processes (described below).

Figure 6:
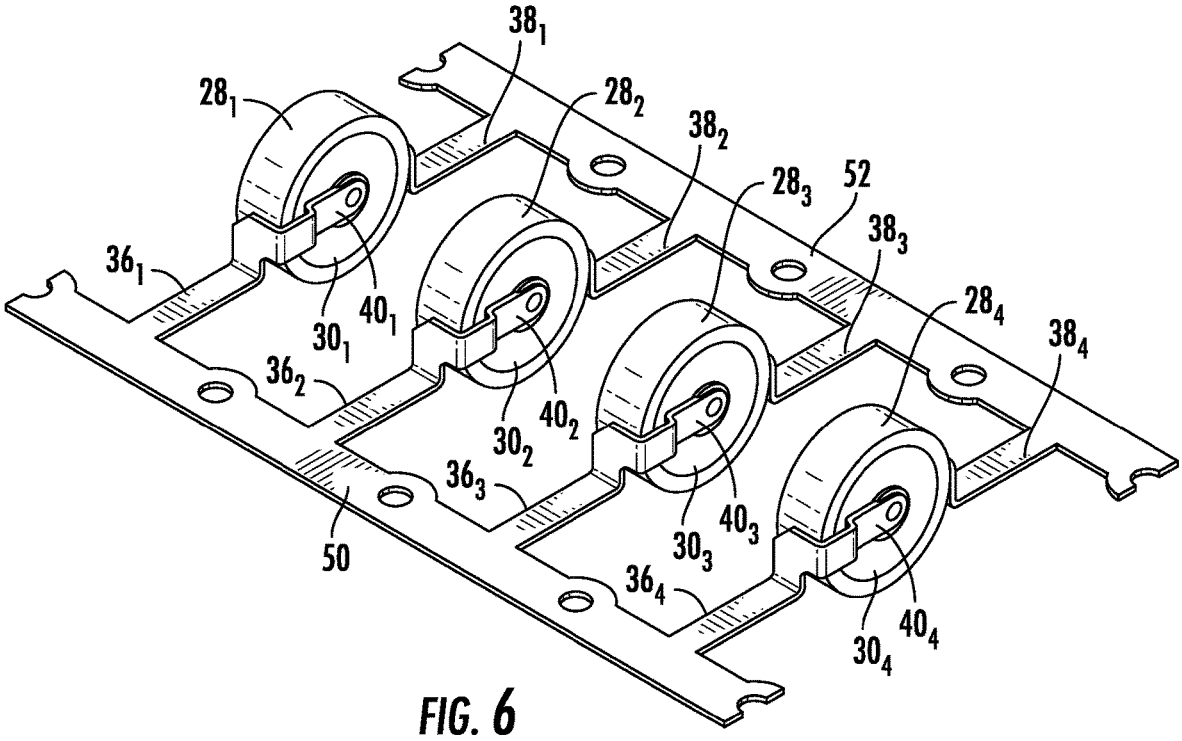

At block 120 of the exemplary method, and as illustrated in FIG. 6, the first and second lead frame portions $\mathbf{36}_{1\text{-}4}$, $\mathbf{38}_{1\text{-}4}$ may be arranged in a confronting, "mirror image" relationship, with the first contact tabs $\mathbf{40}_{1\text{-}4}$ of the first lead frame portions $\mathbf{36}_{1\text{-}4}$ disposed in a confronting, parallel relationship with the second contact tabs $\mathbf{42}_{1\text{-}4}$ of the second lead frame portions $\mathbf{38}_{1\text{-}4}$. MOV chips $\mathbf{28}_{1\text{-}4}$ may then be disposed between the confronting first and second contact tabs $\mathbf{40}_{1\text{-}4}$, $\mathbf{42}_{1\text{-}4}$, and the first and second contact tabs $\mathbf{40}_{1\text{-}4}$, $\mathbf{42}_{1\text{-}4}$ may be soldered to the first and second electrodes $\mathbf{30}_{1\text{-}4}$, $\mathbf{32}_{1\text{-}4}$ of the MOV chips $\mathbf{28}_{1\text{-}4}$.

Figure 7:
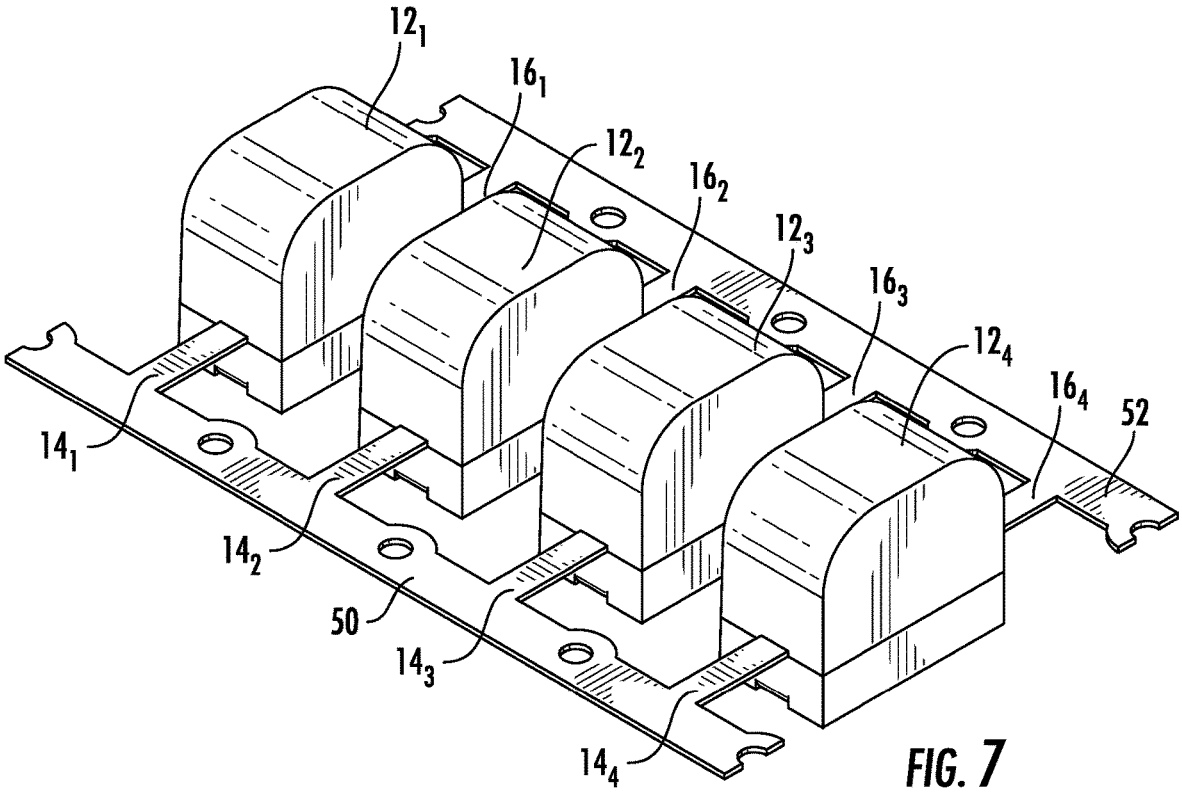

At block 130 of the exemplary method, and as illustrated in FIG. 7, Each MOV chip $\mathbf{28}_{1\text{-}4}$ and its corresponding first and second contact tabs $\mathbf{40}_{1\text{-}4}$, $\mathbf{42}_{1\text{-}4}$ are placed within a mold (not shown), and the plastic device bodies $\mathbf{12}_{1\text{-}4}$ may be overmolded thereon, with the first and second leads $\mathbf{14}_{1\text{-}4}$, $\mathbf{16}_{1\text{-}4}$ of each of the first and second lead frame portions $\mathbf{36}_{1\text{-}4}$, $\mathbf{38}_{1\text{-}4}$ extending horizontally out of the device bodies $\mathbf{12}_{1\text{-}4}$ (and still attached to the respective first and second frame members 50, 52).

Figure 8:
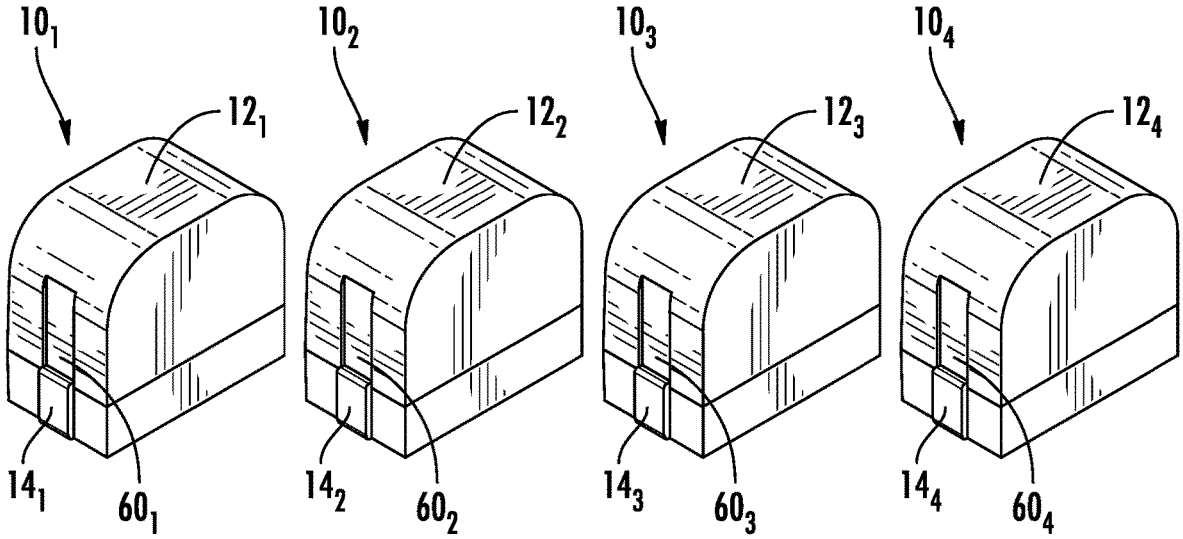

At block 140 of the exemplary method, and as illustrated in FIG. 8, the first and second leads $\mathbf{14}_{1\text{-}4}$, $\mathbf{16}_{1\text{-}4}$ of each of the first and second lead frame portions $\mathbf{36}_{1\text{-}4}$, $\mathbf{38}_{1\text{-}4}$ may be cut away from their respective first and second frame members 50, 52 and may be bent or folded around the undersides of their respective device bodies $\mathbf{12}_{1\text{-}4}$ and disposed within complementary recesses formed in the bottom surfaces of the device bodies $\mathbf{12}_{1\text{-}4}$ (e.g., as described above and as shown in FIG. 1B) to form the completed devices $\mathbf{10}_{1\text{-}4}$. In various embodiments, prior to bending or folding of the first and second leads $\mathbf{14}_{1\text{-}4}$, $\mathbf{16}_{1\text{-}4}$, recesses or slots $\mathbf{60}_{1\text{-}4}$ may be formed in the front and rear surfaces of the device bodies $\mathbf{12}_{1\text{-}4}$ directly above the areas where first and second leads $\mathbf{14}_{1\text{-}4}$, $\mathbf{16}_{1\text{-}4}$ extend out of the device bodies $\mathbf{12}_{1\text{-}4}$ (only the slots $\mathbf{60}_{1\text{-}4}$ on the front surfaces of the device bodies $\mathbf{12}_{1\text{-}4}$ are visible in FIG. 8, but it will be understood that identical slots are formed in the rear surfaces of the device bodies $\mathbf{12}_{1\text{-}4}$). The slots $\mathbf{60}_{1\text{-}4}$ may have widths that are equal to or greater than the widths of the first and second leads $\mathbf{14}_{1\text{-}4}$, $\mathbf{16}_{1\text{-}4}$. The slots $\mathbf{60}_{1\text{-}4}$ provide clearance above the first and second leads $\mathbf{14}_{1\text{-}4}$, $\mathbf{16}_{1\text{-}4}$ so that, when the first and second leads $\mathbf{14}_{1\text{-}4}$, $\mathbf{16}_{1\text{-}4}$ are bent or folded into their final configuration, the portions of the device bodies $\mathbf{12}_{1\text{-}4}$ directly above the first and second leads $\mathbf{14}_{1\text{-}4}$, $\mathbf{16}_{1\text{-}4}$ are not subjected to stresses that could otherwise result in cracking of the device bodies $\mathbf{12}_{1\text{-}4}$.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A metal oxide varistor (MOV) device comprising:

a MOV chip having first and second electrodes disposed on opposing side thereof;

a first lead frame portion comprising:

a first contact tab electrically connected to the first electrode; and a first lead contiguous with the first contact tab and extending away from the MOV chip for connecting the MOV device within a circuit;

a second lead frame portion comprising:

a second contact tab electrically connected to the second electrode; and a second lead contiguous with the second contact tab and extending away from the MOV chip for connecting the MOV device within the circuit; and a device body encasing the MOV chip, the first contact tab, the second contact tab, and portions of the first and second leads, wherein the first and second leads extend out of the device body and are bent into flat abutment with a bottom surface of the device body, the device body having a slot above an area where the first lead extends out of the device body.

2. The MOV device of claim 1, wherein portions of the first and second leads are disposed within complementary recesses formed in the bottom surface of the device body and are coplanar with the bottom surface of the device body.

3. The MOV device of claim 1, wherein a bottom surface of the MOV device is flat.

4. The MOV device of claim 1, wherein the device body is formed of a heat resistant polymer.

5. The MOV device of claim 4, wherein the device body is formed of one of a liquid-crystal polymer and a polyphenylene sulfide.

6. The MOV device of claim 1, wherein at least one of the first and second contact tabs is bent to define a kinked portion that spaced apart from an edge of the MOV chip.

7. The MOV device of claim 6, wherein the kinked portion a spaced apart from the edge of the MOV chip by at least 0.70 millimeters.

8. The MOV device of claim 1, wherein each of the first and second leads is bent into a "C" shape that extends away from the MOV chip, along a side of the device body, and along the bottom surface of the device body.

9. The MOV device of claim 1, wherein a fold at a juncture of the first lead and the first contact tab the first and second lead frame portion has an embossed rib formed therein.

10. A metal oxide varistor (MOV) device comprising:

a MOV chip having first and second electrodes disposed on opposing side thereof;

a first lead frame portion comprising:

a first contact tab electrically connected to the first electrode; and a first lead contiguous with the first contact tab and extending away from the MOV chip for connecting the MOV device within a circuit;

a second lead frame portion comprising:

a second contact tab electrically connected to the second electrode; and a second lead contiguous with the second contact tab and extending away from the MOV chip for connecting the MOV device within a circuit; and a plastic device body encasing the MOV chip, the first contact tab, the second contact tab, and portions of the first and second leads, wherein the first and second leads extend out of the device body and are bent into flat abutment with a bottom surface of the device body, with portions of the first and second leads disposed within complementary recesses formed in the bottom surface, the device body having a slot above an area where the first lead extends out of the device body.

11. A method of manufacturing a metal oxide varistor (MOV) device, the method comprising:

stamping first and second lead frame portions out of a sheet of metal, the first and second lead frame portions being "L" shaped and extending from respective first and second frame members;

separating the first lead frame portion from the second lead frame portion;

bending the first and second leads frame portions to define respective first and second contact tabs;

arranging the first and second leads frame portions in a mirror image relationship with the first contact tab of the first lead frame portion disposed in a confronting, parallel relationship with the second contact tab of the second lead frame portion;

placing a MOV chip between the first and second contact tabs and electrically connecting the first and second contact tabs to respective first and second electrodes of the MOV chip;

overmolding a device body onto the MOV chip, the first and second contact tabs, and portions of first and second leads of the first and second lead frame portions;

cutting the first and second leads away from the first and second frame members;

bending the first and second leads into flat abutment with a bottom surface of the device body; and forming a slot in the device body above an area where the first lead extends out of the device body.

12. The method of claim 11, wherein bending the first and second leads comprises disposing portions of the first and second leads within complementary recesses in the bottom surface of the device body so that the first and second leads are coplanar with the bottom surface of the device body.

13. The method of claim 11, wherein the device body is formed of a heat resistant polymer.

14. The method of claim 13, wherein the device body is formed of one of a liquid-crystal polymer and a polyphenylene sulfide.

15. The method of claim 11, further including bending at least one of the first and second contact tabs to define a kinked portion that is spaced apart from an edge of the MOV chip.

16. The method of claim 15, wherein the kinked portion is spaced apart from the edge of the MOV chip by at least 0.70 millimeters.

17. The method of claim 11, wherein each of the first and second leads is bent into a "C" shape that extends away from the MOV chip, along a side of the device body, and along the bottom surface of the device body.

18. The method of claim 11, stamping first and second lead frame portions incudes forming an embossed rib in a fold at a juncture of the first lead and the first contact tab of the first lead frame portion.

* * * * *